US011808197B1

(12) United States Patent
Nagoshi

(10) Patent No.: US 11,808,197 B1
(45) Date of Patent: Nov. 7, 2023

(54) CONTROLLER FOR VEHICLE AND METHOD FOR ESTIMATING TEMPERATURE OF COMPONENT OF INTERNAL COMBUSTION ENGINE

(71) Applicant: TOYOTA JIDOSHA KABUSHIKI KAISHA, Toyota (JP)

(72) Inventor: Kazuaki Nagoshi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/190,193

(22) Filed: Mar. 27, 2023

(30) Foreign Application Priority Data

May 11, 2022 (JP) ..... 2022-078377

(51) Int. Cl.
*F01P 11/14* (2006.01)

(52) U.S. Cl.
CPC ..... *F01P 11/14* (2013.01); *F01P 2023/00* (2013.01); *F01P 2025/46* (2013.01); *F01P 2025/66* (2013.01)

(58) Field of Classification Search
CPC .... F01P 11/14; F01P 2023/00; F01P 2025/46; F01P 2025/66; F02D 41/22; F02D 2200/02; F02D 2200/021; F02D 2200/022
See application file for complete search history.

(56) References Cited

U.S. PATENT DOCUMENTS 6,542,853 B1 4/2003 Murakami et al.
2015/0268102 A1* 9/2015 Miyata ..... G01K 11/00 702/50
2017/0361698 A1* 12/2017 Hussain ..... F01P 5/06
2018/0087450 A1* 3/2018 Karnik ..... F02B 29/0443

FOREIGN PATENT DOCUMENTS

JP 11-211622 A 8/1999
JP 2009-287507 A 12/2009

* cited by examiner

*Primary Examiner* — Grant Moubry
(74) *Attorney, Agent, or Firm* — Oblon, McClelland, Maier & Neustadt, L.L.P.

(57) ABSTRACT

A controller for a vehicle executes a base temperature calculation process that calculates a base temperature of a component of the internal combustion engine, a correction value calculation process that calculates a correction value, a vehicle line reflection process when the vehicle including the component of which temperature is estimated is a temperature-estimated vehicle that is in a line of vehicles in order to reflect, on the correction value, a tendency of the component to be less cooled when the temperature-estimated vehicle is a trailing vehicle than when the temperature-estimated vehicle is a leading vehicle, a rearmost reflection process when the temperature-estimated vehicle is in the line of vehicles in order to reflect, on the correction value, a tendency of the component to be more cooled when the temperature-estimated vehicle is a rearmost vehicle, and a component temperature estimation process that corrects the base temperature with the correction value.

11 Claims, 4 Drawing Sheets

Fig.4

| | | KL → High | | | | |
|---|---|---|---|---|---|---|
| | | 10 | ··· | 40 | ··· | 100 |
| NE ↓ High | 800 | 600 | ··· | 700 | | 800 |
| | ⋮ | ⋮ | 700 | ⋮ | 800 | 800 |
| | | | | | 800 | 800 |
| | 3000 | 700 | ··· | 800 | 800 | 800 |
| | ⋮ | ⋮ | 800 | 800 | 800 | 800 |
| | 6000 | 800 | 800 | 800 | 800 | 800 |

Fig.5

| | SPD → High | | | | |
|---|---|---|---|---|---|
| | 0 | ··· | 80 | ··· | 160 |
| Cor | 0 | ··· | -50 | ··· | -100 |

Fig.6

| | | SPD → High | | | | |
|---|---|---|---|---|---|---|
| | | 0 | ··· | 80 | ··· | 160 |
| PN | 1 | 0 | ··· | 2 | ··· | 10 |
| | 2 | 0 | ··· | 40 | ··· | 80 |
| | 3 | 0 | ··· | 50 | ··· | 90 |
| | 4 | 0 | ··· | 50 | ··· | 100 |

Fig.7

| | SPD → High | | | | |
|---|---|---|---|---|---|
| | 0 | ··· | 80 | ··· | 160 |
| Ref2 | 0 | ··· | -5 | ··· | -20 |

CONTROLLER FOR VEHICLE AND METHOD FOR ESTIMATING TEMPERATURE OF COMPONENT OF INTERNAL COMBUSTION ENGINE

BACKGROUND

1. Field

The following description relates to a controller for a vehicle and a method for estimating the temperature of a component of an internal combustion engine.

2. Description of Related Art

Japanese Laid-Open Patent Publication No. 2009-287507 describes a controller for a vehicle that estimates the temperature of a component of an internal combustion engine. The component of the internal combustion engine is, for example, an exhaust manifold. Ambient air flows by the component more quickly as the vehicle speed increases. Thus, the temperature of the component tends to be lower at higher vehicle speeds. The above controller estimates the temperature of the component to be lower at higher vehicle speeds.

The estimated temperature of the component can be used, for example, to calculate heat damage to the component. Examples of heat damage to the component include high-temperature fatigue caused by exposure to high temperatures and thermal fatigue caused by repeated rising and falling of the temperature. The calculated damage to the component can be used to estimate the life of the component.

The temperature of the component of the internal combustion engine needs to be obtained in order to appropriately recognize the heat damage. In this manner, there is a need to estimate the temperature of the component of the internal combustion engine.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a controller for a vehicle including an internal combustion engine is provided. The controller includes processing circuitry. The processing circuitry is configured to execute a base temperature calculation process that calculates a base temperature of a component of the internal combustion engine from information on a driving state of the internal combustion engine. The processing circuitry is further configured to execute a correction value calculation process that calculates a correction value for correcting the base temperature from information on the speed of the vehicle. The processing circuitry is further configured to execute a vehicle line reflection process when the vehicle including the component of which temperature is estimated is a temperature-estimated vehicle that is in a line of vehicles in order to reflect, on the correction value, a tendency of the component to be less cooled when the temperature-estimated vehicle is a trailing vehicle than when the temperature-estimated vehicle is a leading vehicle. The processing circuitry is further configured to execute a rearmost reflection process when the temperature-estimated vehicle is in the line of vehicles in order to reflect, on the correction value, a tendency of the component to be more cooled when the temperature-estimated vehicle is a rearmost vehicle than when the temperature-estimated vehicle is not the rearmost vehicle. The processing circuitry is further configured to execute a component temperature estimation process that estimates the temperature of the component of the internal combustion engine by correcting the base temperature with the correction value.

In another general aspect, a method for estimating a temperature of a component of an internal combustion engine installed in a vehicle is provided. The method includes executing a base temperature calculation process that calculates a base temperature of the component of the internal combustion engine from information on a driving state of the internal combustion engine. The method further includes executing a correction value calculation process that calculates a correction value for correcting the base temperature from information on the speed of the vehicle. The method further includes executing a vehicle line reflection process when the vehicle including the component of which temperature is estimated is a temperature-estimated vehicle that is in a line of vehicles in order to reflect, on the correction value, a tendency of the component to be less cooled when the temperature-estimated vehicle is a trailing vehicle than when the temperature-estimated vehicle is a leading vehicle. The method further includes executing a rearmost reflection process when the temperature-estimated vehicle is in the line of vehicles in order to reflect, on the correction value, a tendency of the component to be more cooled when the temperature-estimated vehicle is a rearmost vehicle than when the temperature-estimated vehicle is not the rearmost vehicle. The method further includes executing a component temperature estimation process that estimates the temperature of the component of the internal combustion engine by correcting the base temperature with the correction value.

Other features and aspects will be apparent from the following detailed description, the drawings, and the claims.

BRIEF DESCRIPTION OF THE DRAWINGS

FIG. 4 is a table illustrating the contents of map data that are used to calculate a base temperature.

FIG. 5 is a table illustrating the contents of map data that are used to calculate a correction value in a correction value calculation process.

FIG. 6 is a table illustrating the contents of map data that are used to execute a vehicle line reflection process.

FIG. 7 is a table illustrating the contents of map data uses that are used to execute a rearmost reflection process.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A controller for a vehicle according to one embodiment will now be described with reference to the drawings.

Configuration of Vehicle 100

Figure 1:
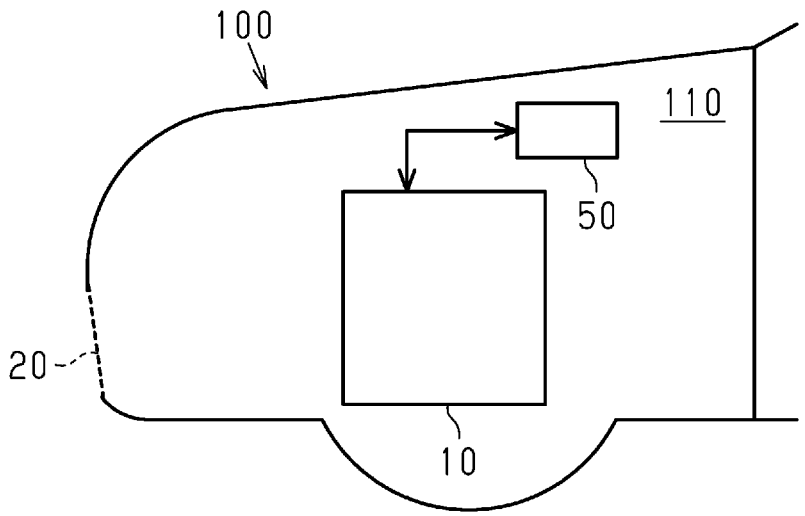
FIG. 1 is a schematic diagram of an internal combustion engine installed in a vehicle and a controller for the vehicle.

As shown in FIG. 1, an internal combustion engine 10 (hereafter referred to as engine 10) is installed in an engine compartment 110 of the vehicle 100. The vehicle 100 includes a controller 50 electrically connected to the engine 10. The controller 50 controls the engine 10. The controller 50 also controls various parts of the vehicle 100 in addition to the engine 10.

The controller 50 estimates the temperature of the components of the engine 10. In this case, the controller 50 estimates the temperature of an exhaust manifold connected to the cylinder head of the engine 10. The exhaust manifold collects the exhaust gases from the cylinders.

As shown in FIG. 1, the vehicle 100 has a front end that includes a grille 20 through which ambient air is drawn into the engine compartment 110. When the vehicle 100 is moving forward, air is drawn into the engine compartment 110 through the grille 20.

The components of the engine 10 are cooled by exchanging heat with the drawn-in air as well as exchanging heat with the coolant circulating in the engine 10. The exhaust manifold is one of the components that are cooled by the drawn-in air.

Configuration of Controller 50

Figure 2:
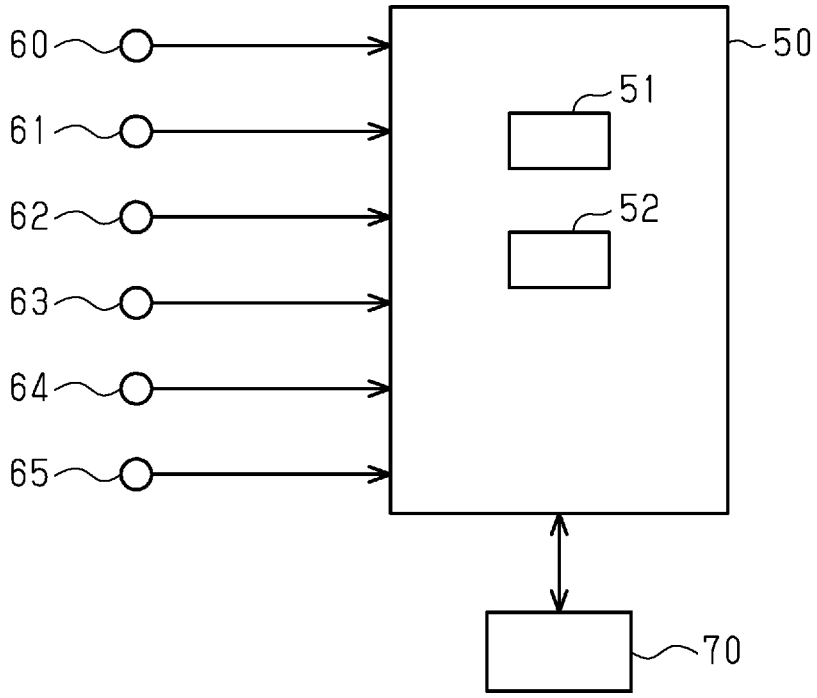
FIG. 2 is a schematic diagram showing the configuration of the controller, sensors connected to the controller, and a communication device used by the controller to communicate with an external device located outside the vehicle.

As shown in FIG. 2, the controller 50 includes a memory device 52 that stores programs and a control unit 51 that executes various types of control in accordance with the programs stored in the memory device 52. The memory device 52 includes, for example, ROM and storage. The control unit 51 includes, for example, a CPU and RAM.

The controller 50 is connected to various types of sensors that detect the state of the engine 10, the state of the vehicle 100, and the like.

For example, the controller 50 is connected to a crank position sensor 60. The crank position sensor 60 outputs a crank angle signal in accordance with a change in the rotation phase of a crankshaft, which is the output shaft of the engine 10. The controller 50 calculates an engine speed NE, indicative of the speed of the crankshaft, based on a detection signal of the rotation angle of the crankshaft sent from the crank position sensor 60.

The controller 50 is connected to an air flowmeter 61. The air flowmeter 61 detects a temperature THA of the air drawn into the cylinders through an intake passage of the engine 10 and an intake air amount GA indicative of the amount of the drawn-in air. The controller 50 obtains information on the temperature THA and the intake air amount GA detected by the air flowmeter 61.

The controller 50 calculates an engine load factor KL based on the engine speed NE and the intake air amount GA. The engine load factor KL is an index value of an air-filling factor in the combustion chambers of the engine 10 indicative of the percentage of an inflow air amount per combustion cycle in a single cylinder relative to a reference inflow air amount. The reference inflow air amount is variably set in accordance with the engine speed NE.

The controller 50 is connected to a vehicle speed sensor 62 that detects a vehicle speed SPD indicative of the speed of the vehicle 100. The controller 50 obtains information on the vehicle speed SPD detected by the vehicle speed sensor 62.

The vehicle 100 includes an onboard camera 63. The onboard camera 63 of the vehicle 100 is configured to capture an image of the road in front of and/or behind the vehicle 100. The controller 50 is connected to the onboard camera 63. The onboard camera 63 outputs data about a captured image of a front vehicle to the controller 50.

The vehicle 100 also includes a millimeter wave radar 64. The millimeter wave radar 64 uses radio waves in the millimeter waveband to detect an object in front of and/or behind the vehicle 100 and outputs a signal in accordance with the detection result to the controller 50.

The vehicle 100 further includes a GPS device 65 and a communication device 70. The GPS device 65 receives signals from GPS satellites and detects the location of the vehicle 100 in, for example, latitude and longitude, based on the signals received from the GPS satellites. The GPS device 65 outputs location information indicative of the detected location (latitude and longitude) of the vehicle 100 to the controller 50. The controller 50 uses the communication device 70 to communicate with an external device located outside the vehicle 100.

Temperature Estimation Control

The controller 50 estimates the temperature of the exhaust manifold as described above. Specifically, when the vehicle 100 is traveling, the controller 50 executes temperature estimation control at regular intervals and estimates the temperature of the exhaust manifold. The controller 50 stores estimated temperature data in the memory device 52 and accumulates the history data about the temperature of the exhaust manifold. The accumulated temperature history data is analyzed to estimate the degree of fatigue of the exhaust manifold in order to determine when to replace the component or identify the cause of an anomaly.

The temperature estimation control will now be outlined.

Figure 3:
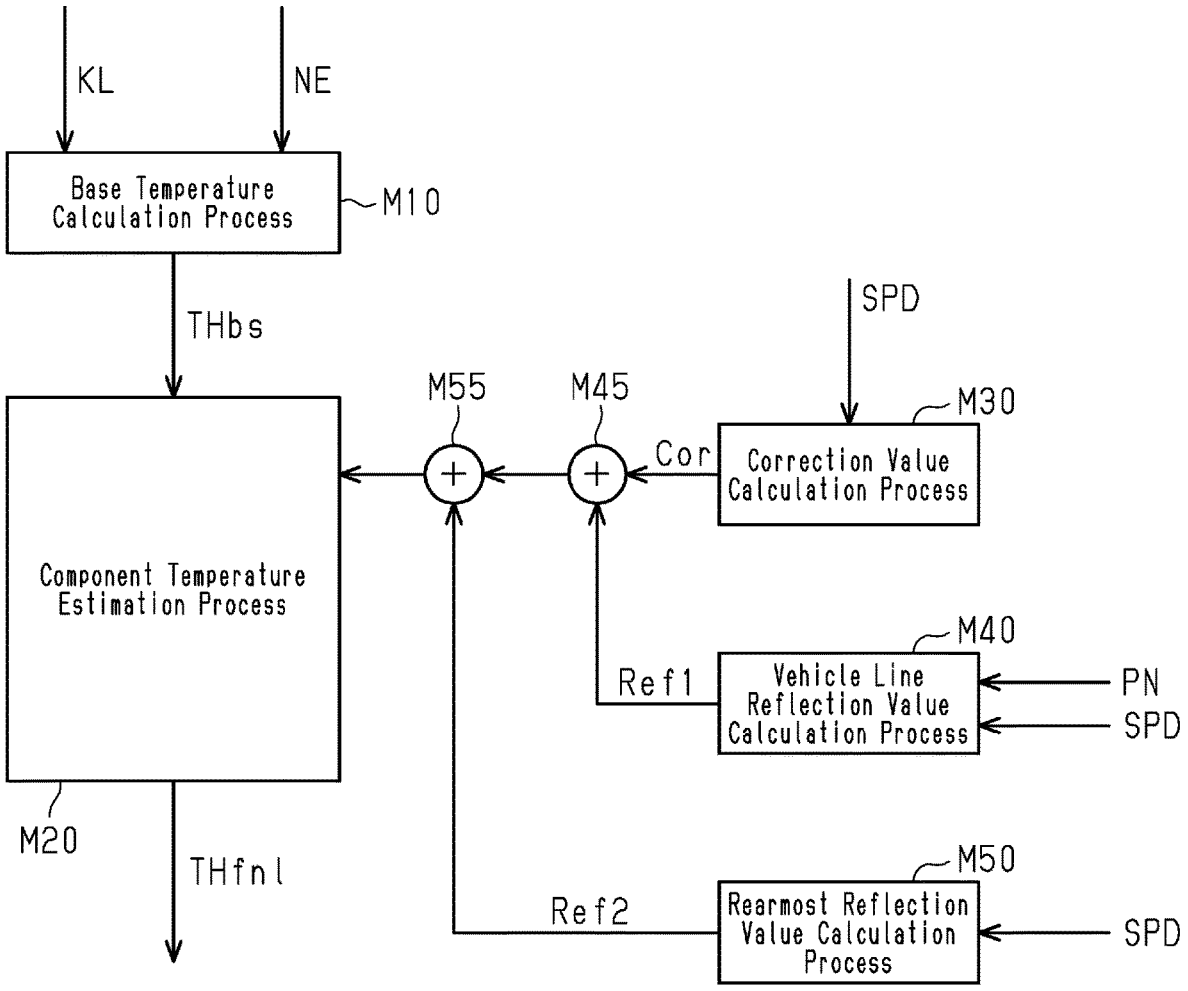
FIG. 3 is a block diagram of temperature estimation control executed by the controller.

As shown in FIG. 3, the temperature estimation control includes a base temperature calculation process M10, a component temperature estimation process M20, a correction value calculation process M30, a vehicle line reflection value calculation process M40, a vehicle line reflection value addition process M45, a rearmost reflection value calculation process M50, and a rearmost reflection value addition process M55. The vehicle line reflection value calculation process M40 and the vehicle line reflection value addition process M45 form a vehicle line reflection process. The rearmost reflection value calculation process M50 and the rearmost reflection value addition process M55 form a rearmost reflection process.

The vehicle 100 including the exhaust manifold of which the temperature is estimated will hereafter be referred to as the temperature-estimated vehicle 100. The controller 50 executes the base temperature calculation process M10, the correction value calculation process M30, and the component temperature estimation process M20 at regular intervals regardless of whether the temperature-estimated vehicle 100 is in a line of vehicles traveling together. The base temperature calculation process M10 calculates a base temperature THbs of the exhaust manifold based on information on the driving state of the engine 10. The correction value calculation process M30 calculates a correction value Cor for correcting the base temperature THbs based on information on the speed of the temperature-estimated vehicle 100. The component temperature estimation process M20 estimates the temperature of the exhaust manifold by correcting the base temperature THbs with the correction value Cor.

If the temperature-estimated vehicle 100 is included in a line of vehicles traveling together, the controller 50 executes the vehicle line reflection process. When the temperature-estimated vehicle 100 is a trailing vehicle such that the exhaust manifold tends to be less cooled than when the temperature-estimated vehicle 100 is a leading vehicle, the vehicle line reflection process reflects this tendency on the correction value Cor. The reason for such a tendency will now be described. The leading vehicle is the first vehicle from the front of a line of vehicles. The trailing vehicle is a vehicle that is second from the front or further toward the end of the line of vehicles. The flow of air toward a trailing vehicle is blocked by the one or more vehicles in front of the trailing vehicle. Thus, there is a tendency of the exhaust manifold of the trailing vehicle to be less cooled than the exhaust manifold of the leading vehicle.

When the temperature-estimated vehicle 100 is a rearmost vehicle, the controller 50 executes the rearmost reflection process. When the temperature-estimated vehicle 100 is the rearmost vehicle such that the exhaust manifold tends to be cooler than when the temperature-estimated vehicle 100 is one of a line of vehicles but not the rearmost vehicle, the rearmost reflection process reflects such a tendency on the correction value Cor. The reason for such a tendency will now be described. The rearmost vehicle is the last vehicle 100 in the line of vehicles. Air flowing along the upper surface of the leading vehicle in a direction opposite to the traveling direction of the leading vehicle is directed toward the rear portion of the rearmost vehicle. Thus, when the temperature-estimated vehicle 100 is the rearmost vehicle, the exhaust manifold of the temperature-estimated vehicle 100 tends to be cooler than when the temperature-estimated vehicle 100 is not the rearmost vehicle.

The temperature estimation control executed by the controller 50 will now be described in detail with reference to FIGS. 3 to 7. The control unit 51 implements the temperature estimation control by executing the programs stored in the memory device 52.

Base Temperature Calculation Process M10

The base temperature calculation process M10 calculates the base temperature THbs of the exhaust manifold based on the engine speed NE and the engine load factor KL that are indicative of the driving state of the engine 10. The control unit 51, in the base temperature calculation process M10, obtains the engine speed NE and the engine load factor KL. The control unit 51 calculates the base temperature THbs based on the obtained engine speed NE and the engine load factor KL.

The memory device 52 stores map data in which the engine load factor KL and the engine speed NE are input variables and the base temperature THbs is an output variable. The control unit 51, in the base temperature calculation process M10, uses the map data to calculate the base temperature THbs. The map data includes combinations of discrete values of input variables and values of corresponding output variables. When, for example, the value of an input variable matches one of the values of the input variables on the map data, the value of the corresponding output variable of the map data is output as the calculation result. When the value of the input variable does not match any of the values of the input variables on the map data, a value obtained by interpolation of multiple values of the output variables included in the map data is obtained as the calculation result.

As shown in FIG. 4, in the map data used for the base temperature calculation process M10, the base temperature THbs is higher when the engine speed NE is higher and the engine load factor Kl is higher. In the example shown in FIG. 4, the engine load factor KL is represented in percentage. The map data is generated by associating the values of output variables with input variables based on the results of experiments and model-based simulations performed in advance. For example, the map data is generated based on the relationship between the temperature of the exhaust manifold when the vehicle is at a standstill and not affected by air currents, the engine load factor KL, and the engine speed NE.

Correction Value Calculation Process M30

The correction value calculation process M30 calculates the correction value Cor based on the vehicle speed SPD detected by the vehicle speed sensor 62. The controller 50, in the correction value calculation process M30, obtains the vehicle speed SPD. The controller 50 calculates the correction value Cor based on the obtained vehicle speed SPD. As will be described later, in the component temperature estimation process M20, the controller 50 estimates the temperature of the exhaust manifold by performing a correction that adds the correction value Cor, which is a negative value, to the base temperature THbs.

The memory device 52 stores map data in which the vehicle speed SPD is an input variable and the correction value Cor is an output variable. The controller 50, in the correction value calculation process M30, uses the map data and calculates the correction value Cor.

As shown in FIG. 5, in the map data for the correction value calculation process M30, the negative value of the correction value Cor decreases as the vehicle speed SPD increases. In other words, the absolute value of the correction value Cor calculated in the correction value calculation process M30 increases as the vehicle speed SPD increases. The map data is generated by, for example, associating the values of output variables with vehicle speeds SPD based on the results of experiments and model-based simulations performed in advance when there is no front vehicle that blocks the flow of air.

Vehicle Line Reflection Value Calculation Process M40 and Vehicle Line Reflection Value Addition Process M45

As described above, if the temperature-estimated vehicle 100 is included in a line of vehicles, the controller 50 executes the vehicle line reflection process. As described above, the vehicle line reflection process includes the vehicle line reflection value calculation process M40 and the vehicle line reflection value addition process M45.

The vehicle line reflection process is executed when a vehicle line flag PF is set. The vehicle line flag PF of the temperature-estimated vehicle 100 is in a set state if the temperature-estimated vehicle 100 is in a line of vehicles.

The vehicle line flag PF will now be described. Each vehicle obtains the location information and the velocity vector of a vehicle 100 traveling nearby. The vehicle 100 sets the vehicle line flag PF based on the obtained location information and the velocity vector. Specifically, when a vehicle 100 is traveling at substantially the same speed as another vehicle and the distance in the traveling direction between the two vehicles is less than or equal to a threshold value distance, it is determined that the vehicle is included in a line of vehicles traveling together. In the example shown in FIG. 8, a vehicle 100A recognizes that it is traveling in the same line of vehicles as a vehicle 100B. In this case, a vehicle line flag PFAB is set in the vehicle 100A. The vehicle 100B recognizes that the vehicle 100A and a vehicle 100C are traveling in the same line of vehicles. In this case, a vehicle line flag $PF_{BA}$ and a vehicle line flag $PF_{BC}$ are set in the vehicle 100B. The vehicle 100C recognizes that the vehicle 100B is traveling in the same line of vehicles. In this case, a vehicle line flag $PF_{CB}$ is set in the vehicle 100C. The distance between the vehicle 100C and a vehicle 100D is greater than the threshold value distance. Thus, a vehicle line flag $PF_{CD}$ is not set in the vehicle 100C. Likewise, a vehicle line flag $PF_{DC}$ is not set in the vehicle 100D because the distance between the vehicle 100D and the vehicle 100C is greater than the threshold value distance. In this manner, the vehicles each set the vehicle line flag PF.

The vehicle line reflection value calculation process M40 includes a process that obtains a vehicle line ordinal number PN indicating that the temperature-estimated vehicle 100 is an N-th vehicle 100 from the front of the vehicle line, where N is an integer equal to or greater than 1. The vehicle line reflection value calculation process M40 calculates a vehicle line reflection value Ref1 based on the vehicle speed SPD and the vehicle line ordinal number PN.

The vehicle line ordinal number PN is recognized in the following manner. As described above, the vehicles each set the vehicle line flag PF individually. The vehicle uses the communication device 70 to share the vehicle line flag PF with the other vehicles. In the example shown in FIG. 8, the vehicle 100A recognizes the vehicle line flags PFAB, $PF_{BA}$, $PF_{BC}$, $PF_{CB}$. Further, the vehicle 100A obtains the location information and the velocity vector of the vehicle 100A, the location information and the velocity vector of the vehicle 100B, and the location information and the velocity vector of the vehicle 100C. The vehicle 100A uses such information to determine that the vehicle 100A, the vehicle 100B, and the vehicle 100C are traveling in a line in this order. That is, in the example shown in FIG. 8, the vehicle 100A determines that the vehicle line ordinal number PN of the vehicle 100A is 1, the vehicle line ordinal number PN of the vehicle 100B is 2, and the vehicle line ordinal number PN of the vehicle 100C is 3. Further, the vehicle 100A determines that the vehicle 100C is the rearmost vehicle. Thus, the vehicle 100A sets a rearmost flag $RF_C$ indicating that the vehicle 100C is the rearmost vehicle.

The memory device 52 stores map data in which the vehicle speed SPD and the vehicle line ordinal number PN are input variables and the vehicle line reflection value Ref1 is an output variable. The controller 50 in the vehicle line reflection value calculation process M40 uses the map data and calculates the vehicle line reflection value Ref1.

As shown in FIG. 6, in the map data for the vehicle line reflection process, the vehicle line reflection value Ref1, which is a positive value, increases as the vehicle line ordinal number PN becomes greater. The map data used for the vehicle line reflection process is generated in advance based on the results of experiments or model-based simulations.

The vehicle line reflection value addition process M45 adds the vehicle line reflection value Ref1, which is a positive value, to the correction value Cor, which is a negative value.

In this manner, the vehicle line reflection process increases the correction value Cor, which is a negative value, as the vehicle line ordinal number PN of the temperature-estimated vehicle 100 becomes greater. This allows the correction value Cor to reflect the tendency of the exhaust manifold to be less cooled as the vehicle line ordinal number PN of the temperature-estimated vehicle 100 becomes greater.

As shown in FIG. 6, when the vehicle line ordinal number PN is 1 and the vehicle speed SPD is a positive value, the vehicle line reflection value Ref1 is a positive value. This indicates that when the temperature-estimated vehicle 100 is the leading vehicle, the temperature-estimated vehicle 100 is less cooled than when traveling solely. Under such a situation, some of the air flowing along the upper surface of the temperature-estimated vehicle 100 in a direction opposite to the traveling direction of the leading vehicle will not reach the rear portion of the leading vehicle and will be directed instead toward the rear portion of the rearmost vehicle.

A greater vehicle line reflection value Ref1 is calculated as the vehicle speed SPD increases. The vehicle line reflection value Ref1 is determined to at least partially offset the correction value Cor, which is a negative value that decreases as the vehicle speed SPD increases.

Rearmost Reflection Value Calculation Process M50 and Rearmost Reflection Value Addition Process M55

As described above, when the temperature-estimated vehicle 100 is the rearmost vehicle, the controller 50 executes the rearmost reflection process. As described above, the rearmost reflection process includes the rearmost reflection value calculation process M50 and the rearmost reflection value addition process M55.

The rearmost reflection process is executed when the vehicle line flag PF is set and a rearmost flag RF is set. When the temperature-estimated vehicle 100 is the rearmost vehicle, the rearmost flag RF is set.

The memory device 52 stores map data in which the vehicle speed SPD is an input variable and a rearmost reflection value Ref2 is an output variable. The controller 50 in the rearmost reflection value calculation process M50 uses the map data and calculates the rearmost reflection value Ref2.

As shown in FIG. 7, in the map data used for the rearmost reflection process, the rearmost reflection value Ref2 is a negative value that decreases as the vehicle speed SPD increases. The map data used for the rearmost reflection process is generated in advance based on the results of experiments or model-based simulations.

The rearmost reflection value addition process M55 adds the rearmost reflection value Ref2, which is a negative value, to the correction value Cor, which is a negative value.

In this manner, the rearmost reflection process decreases the correction value Cor, which is a negative value. This allows the correction value Cor to reflect the tendency of the exhaust manifold to be more cooled when the temperature-estimated vehicle 100 is the rearmost vehicle than when the temperature-estimated vehicle 100 is included in a line of vehicles but not the rearmost vehicle.

Component Temperature Estimation Process M20

The component temperature estimation process M20 shown in FIG. 3 estimates the temperature of the exhaust manifold by performing a correction that adds the correction value Cor, which is a negative value, to the base temperature THbs. If the temperature-estimated vehicle 100 is one of a line of vehicles, the correction value Cor reflects the vehicle line reflection value Ref1. When the temperature-estimated vehicle 100 is the rearmost vehicle, the correction value Cor reflects the rearmost reflection value Ref2.

The controller 50 outputs a final temperature value THfn1, which is a corrected value, as an estimated value for the temperature of the exhaust manifold.

Inter-Vehicle Communication

Figure 8:
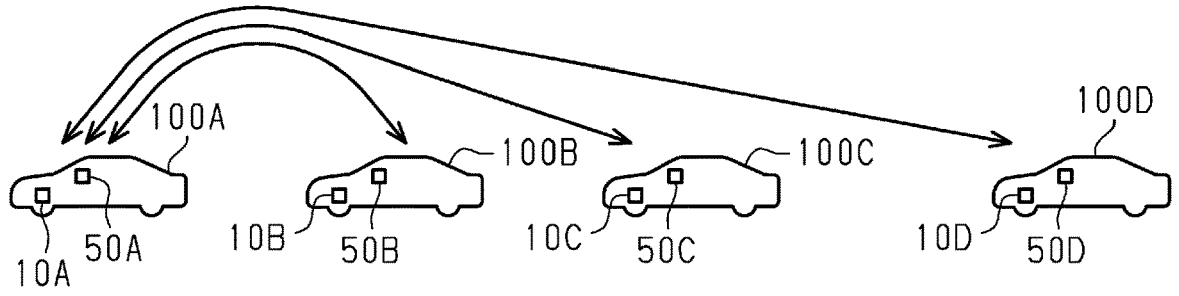
FIG. 8 is a conceptual diagram of inter-vehicle communication.

A vehicle line of the vehicles 100A, 100B, 100C will now be described with reference to FIG. 8. The vehicle 100A, the vehicle 100B, the vehicle 100C, and the vehicle 100D are arranged in this order in the traveling direction. The vehicle 100A includes an engine 10A and a controller 50A. The vehicle 100B includes an engine 10B and a controller 50B. The vehicle 100C includes an engine 10C and a controller 50C. The vehicle 100D includes an engine 10D and a controller 50D.

Estimation of the temperature of the exhaust manifold of the vehicle 100C performed by the controller 50A will now be described with reference to FIG. 8. The controller 50A executing the temperature estimation control is installed in the vehicle 100A, which differs from the temperature-estimated vehicle 100C. The controller 50B transmits the location information of the vehicle 100B to the vehicle 100A. The controller 50C transmits the location information of the vehicle 100C to the vehicle 100A. The controller 50D transmits the location information of the vehicle 100D to the vehicle 100A. The controller 50A determines that the vehicles 100A, 100B, 100C are in a vehicle line based on the received location information. For example, the controller 50A determines that the vehicles 100A, 100B, 100C are in a vehicle line because the vehicles 100A, 100B, 100C are close to one another. In addition, the controller 50A may determine that the vehicles 100A, 100B, 100C are in a vehicle line because the velocity vectors of the vehicles 100A, 100B, 100C are approximate to one another. In this case, the velocity vectors can be obtained from time-series data about location information. Instead or in addition, the controller 50A may determine that the vehicles 100A, 100B, 100C are in a vehicle line based on a detection result of the onboard camera 63 and/or the millimeter wave radar 64. The controller 50A estimates the temperature of the exhaust manifold of the vehicle 100C based on various types of information obtained from the vehicle 100C.

Estimation of the temperature of the exhaust manifold of the vehicle 100A performed by the controller 50A will now be described with reference to FIG. 8. The controller 50A executing the temperature estimation control is installed in a temperature-estimated vehicle 100A. As described above, the controller 50A determines that the vehicles 100A, 100B, 100C are in a vehicle line based on the received location information. The controller 50A estimates the temperature of the exhaust manifold of vehicle 100A based on various types of information.

Advantages of Present Embodiment (1) When the temperature-estimated vehicle 100 is a trailing vehicle, a front vehicle will block the air flowing toward the temperature-estimated vehicle 100. Thus, when temperature-estimated vehicle 100 is a trailing vehicle, the exhaust manifold of the temperature-estimated vehicle 100 tends to be less cooled than the exhaust manifold of the leading vehicle. The present embodiment reflects this tendency on the correction value Cor in the vehicle line reflection process. Air flowing along the upper surface of the leading vehicle in a direction opposite to the traveling direction of the leading vehicle moves around to the rear portion of the rearmost vehicle. Thus, when the temperature-estimated vehicle 100 is the rearmost vehicle, the exhaust manifold of the temperature-estimated vehicle 100 tends to be more cooled than when the temperature-estimated vehicle 100 is not the rearmost vehicle. The present embodiment reflects this tendency on the correction value Cor in the rearmost reflection process. In this manner, the present embodiment allows the temperature of the exhaust manifold to be estimated reflecting the effect of where the temperature-estimated vehicle 100 is located in a vehicle line. This improves the accuracy for estimating the temperature of the exhaust manifold.

(2) The flow of air toward a vehicle that is second from the front or further towards the end of a line of vehicles is blocked by one or more front vehicles. Thus, when the vehicle line ordinal number PN of the temperature-estimated vehicle 100 is greater, the components of the temperature-estimated vehicle 100 tend to be less cooled. The present embodiment allows such a tendency to be reflected on the correction value Cor.

Modifications

The present embodiment may be modified as described below. The present embodiment and the following modifications can be combined if the combined modifications remain technically consistent with each other.

The subject of temperature estimation is not limited to the exhaust manifold. The temperature estimation control described above is suitable when estimating the temperature of a component cooled by flowing air.

In the above embodiment, the vehicle line reflection value calculation process M40 calculates the vehicle line reflection value Ref1 based on the vehicle speed SPD and the vehicle line ordinal number PN. Instead, for example, the vehicle line reflection value calculation process M40 may calculate the vehicle line reflection value Ref1 based on the vehicle speed SPD and whether the temperature-estimated vehicle 100 is the leading vehicle. Specifically, the tendency of a component to be less cooled when the temperature-estimated vehicle 100 is a trailing vehicle than when the temperature-estimated vehicle 100 is the leading vehicle may be reflected through the vehicle line reflection process on the correction value Cor by increasing the correction value Cor, which is a negative value. In other words, the value reflected on the correction value Cor when the temperature-estimated vehicle 100 is the second vehicle from the front of the vehicle line may be equal to the value reflected on the correction value Cor when the temperature-estimated vehicle 100 is the third vehicle.

In the above embodiment, the component temperature estimation process M20 estimates the temperature of the exhaust manifold by performing a correction that adds the correction value Cor, which is a negative value, to the base temperature THbs. Alternatively, the component temperature estimation process M20 may estimate the temperature of the exhaust manifold by performing a correction that subtracts a correction value Cor that has a positive value from the base temperature THbs. In this case, the processes in the above embodiment are modified as follows. The vehicle line reflection process reflects, on the correction value Cor, the tendency of the exhaust manifold to be less cooled when the temperature-estimated vehicle 100 is a trailing vehicle than when the temperature-estimated vehicle 100 is a leading vehicle by reducing the correction value Cor, which is a positive value. The rearmost reflection process reflects, on the correction value Cor, the tendency of the exhaust manifold to be more cooled when the temperature-estimated vehicle 100 is a rearmost vehicle than when the temperature-estimated vehicle 100 is included in a line of vehicles but not the rearmost vehicle. Specifically, the rearmost reflection process increases the correction value Cor, which is a positive value. The vehicle line reflection process includes a process that obtains a vehicle line ordinal number PN indicating that the temperature-estimated vehicle 100 is an N-th vehicle 100 from the front of the vehicle line. The vehicle line reflection process further includes a process that decreases the correction value Cor, which is a positive value, as the vehicle line ordinal number PN of the temperature-estimated vehicle 100 becomes greater.

In the above embodiment, the temperature estimation control is executed through inter-vehicle communication performed by the vehicles included in a line of vehicles. Instead, as will be described below, an external server located outside the temperature-estimated vehicle 100 may execute the temperature estimation control. A data center 200 serving as a server will now be described.

Figure 9:
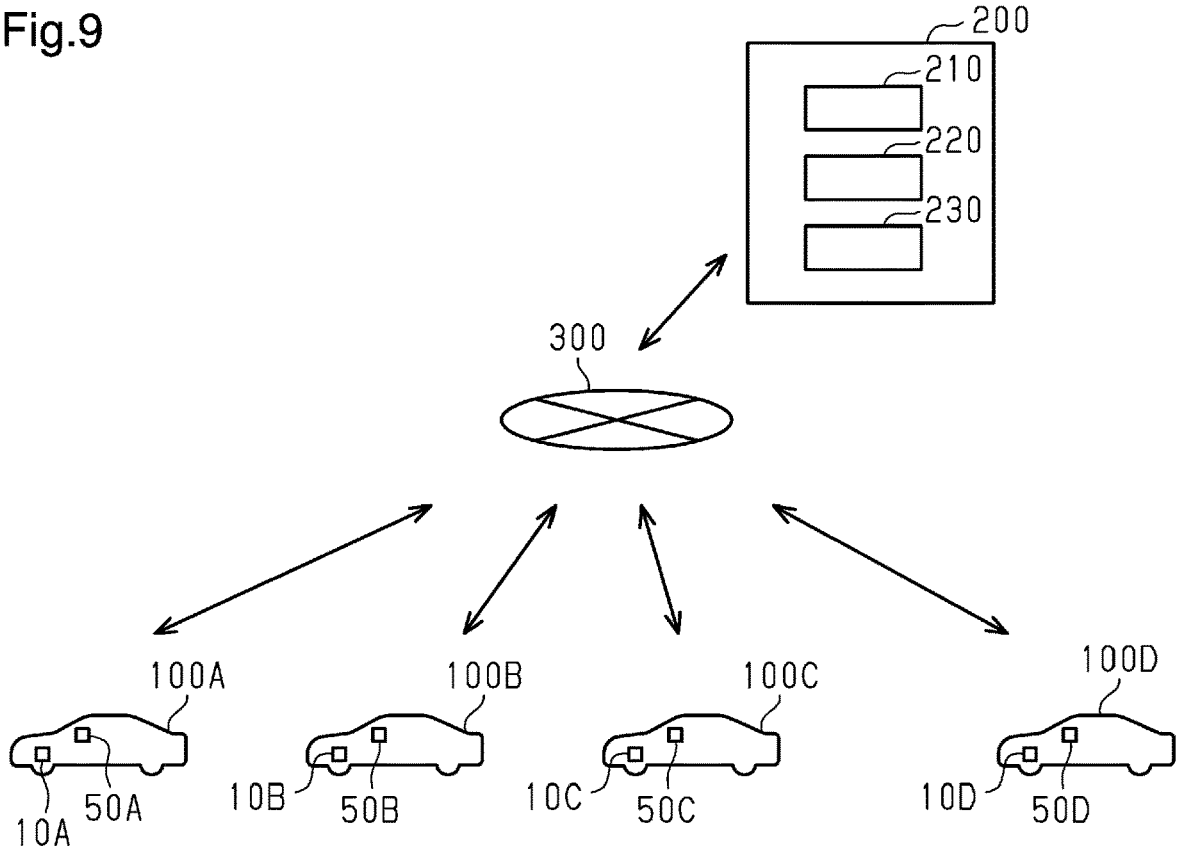
FIG. 9 is a conceptual diagram of a traffic control network.

To implement such a configuration, a traffic control network needs to be built including the data center 200 that receives location information from vehicles as shown in FIG. 9.

The data center 200 of the traffic control network is connected, in a manner allowing for communication, to the vehicles 100 over a communication network 300. As shown in FIG. 9, the data center 200 includes a memory device 220 that stores a program and an execution device 210 that executes the program stored in the memory device 220 to implement various processes. The execution device 210 includes a processor.

The data center 200 also includes a communication device 230. The communication device 230 is implemented in hardware such as a network adapter, various types of communication software, or a combination thereof. The communication device 230 is configured to perform wired or wireless communication over the communication network 300.

The data center 200 may include computers. For example, the data center 200 may include server devices.

The GPS device 65 of the vehicle 100 receives signals from GPS satellites and detects the location of the vehicle 100 in, for example, latitude and longitude, based on the signals received from the GPS satellites. The GPS device 65 outputs location information indicative of the detected location (latitude and longitude) of the vehicle 100 to the controller 50. The controller 50 uses the communication device 70 to transmit the location information position to the data center 200 The controller 50 transmits the base temperature THbs or information used to calculate the base temperature THbs to the data center 200.

The communication device 70 is implemented in hardware such as a network adapter, various types of communication software, or a combination thereof. The communication device 70 is configured to perform wired or wireless communication over the communication network 300.

In the following case, the vehicle 100B is a temperature-estimated vehicle 100B. The data center 200 determines that the temperature-estimated vehicle 100B is in a line of vehicles 100A, 100B, 100C based on location information received from the vehicles 100A, 100B, 100C, 100D. For example, the data center 200 determines that the vehicles 100A, 100B, 100C are in a vehicle line when the vehicles 100A, 100B, 100C are near one another. The data center 200 also calculates the vehicle speed SPD based on time-series data about the location information of the temperature-estimated vehicle 100B. The data center 200 uses various types of information obtained and executes the temperature estimation control.

Thus, the controller 50 uses the communication device 70 to obtain an estimated value for the temperature of the exhaust manifold from the data center 200 through communication over the communication network 300.

In the above embodiment, the vehicle 100 includes the onboard camera 63, the millimeter wave radar 64, and the GPS device 65. The onboard camera 63, the millimeter wave radar 64, and the GPS device 65 may be omitted. In this case, a user of the vehicle 100 inputs data that specifies a vehicle 100 in a line of vehicles to the controller 50. The vehicle line reflection process and the rearmost reflection process may be executed based on the input data.

In the above embodiment, the controller 50 includes a CPU, ROM, and RAM and executes software processing. However, this is only an example. For example, the controller 50 may include a dedicated hardware circuit (such as ASIC) that executes at least part of the software processes executed in the above embodiment. That is, the controller 50 may be modified to have any one of the following configurations (a) to (c). (a) The controller 50 includes a processor that executes all processes according to programs and a program storage device such as ROM that stores the programs. That is, the controller 50 includes a software execution device. (a) The controller 50 includes a processor that executes part of processes according to programs and a program storage device. The controller 50 further includes a dedicated hardware circuit that executes the other processes. (c) The controller 50 includes a dedicated hardware circuit that executes all processes. A plurality of software execution devices and/or a plurality of dedicated hardware circuits may be provided. In other words, the above processes may be executed by processing circuitry that includes at least one of a software executing device and a dedicated hardware circuit. A plurality of software execution devices and a plurality of dedicated hardware circuits may be included in the processing circuitry. The program storage device, or computer-readable media, includes any type of media that are accessible by general-purpose computers and dedicated computers.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for a vehicle including an internal combustion engine, the controller comprising:

processing circuitry, wherein the processing circuitry is configured to execute a base temperature calculation process that calculates a base temperature of a component of the internal combustion engine from information on a driving state of the internal combustion engine, the processing circuitry is configured to execute a correction value calculation process that calculates a correction value for correcting the base temperature from information on a speed of the vehicle, the processing circuitry is configured to execute a vehicle line reflection process when the vehicle including the component of which temperature is estimated is a temperature-estimated vehicle that is in a line of vehicles in order to reflect, on the correction value, a tendency of the component to be less cooled when the temperature-estimated vehicle is a trailing vehicle than when the temperature-estimated vehicle is a leading vehicle, the processing circuitry is configured to execute a rearmost reflection process when the temperature-estimated vehicle is in the line of vehicles in order to reflect, on the correction value, a tendency of the component to be more cooled when the temperature-estimated vehicle is a rearmost vehicle than when the temperature-estimated vehicle is not the rearmost vehicle, and the processing circuitry is configured to execute a component temperature estimation process that estimates the temperature of the component of the internal combustion engine by correcting the base temperature with the correction value.

2. The controller according to claim 1, wherein, the component temperature estimation process corrects the base temperature by adding the correction value that is a negative value to the base temperature in order to estimate the temperature of the component of the internal combustion engine, an absolute value of the correction value calculated in the correction value calculation process is increased as the speed of the vehicle increases, the vehicle line reflection process reflects, on the correction value, the tendency of the component to be less cooled when the temperature-estimated vehicle is the trailing vehicle than when the temperature-estimated vehicle is the leading vehicle by increasing the correction value, which is a negative value, and the rearmost reflection process reflects, on the correction value, the tendency of the component to be more cooled when the temperature-estimated vehicle is the rearmost vehicle than when the temperature-estimated vehicle is not the rearmost vehicle by decreasing the correction value, which is a negative value.

3. The controller according to claim 1, wherein, the component temperature estimation process corrects the base temperature by subtracting the correction value that is a positive value from the base temperature in order to estimate the temperature of the component of the internal combustion engine, an absolute value of the correction value calculated in the correction value calculation process is increased as the speed of the vehicle increases, the vehicle line reflection process reflects, on the correction value, the tendency of the component to be less cooled when the temperature-estimated vehicle is the trailing vehicle than when the temperature-estimated vehicle is the leading vehicle by decreasing the correction value, which is a positive value, and the rearmost reflection process reflects, on the correction value, the tendency of the component to be more cooled when the temperature-estimated vehicle is the rearmost vehicle than when the temperature-estimated vehicle is not the rearmost vehicle by increasing the correction value, which is a positive value.

4. The controller according to claim 1, wherein the vehicle line reflection process includes:

a process that obtains a vehicle line ordinal number indicating that the temperature-estimated vehicle is an N-th vehicle from a front of the line of vehicles; and a process that reflects, on the correction value, a tendency of the component to be less cooled as the vehicle line ordinal number of the temperature-estimated vehicle becomes greater.

5. The controller according to claim 2, wherein the vehicle line reflection process includes:

a process that obtains a vehicle line ordinal number indicating that the temperature-estimated vehicle is an N-th vehicle from a front of the line of vehicles; and a process that increases the correction value, which is a negative value, as the vehicle line ordinal number of the temperature-estimated vehicle becomes greater.

6. The controller according to claim 3, wherein the vehicle line reflection process includes:

a process that obtains a vehicle line ordinal number indicating that the temperature-estimated vehicle is an N-th vehicle from a front of the line of vehicles; and a process that decreases the correction value, which is a positive value, as the vehicle line ordinal number of the temperature-estimated vehicle becomes greater.

7. The controller according to claim 1, wherein the base temperature calculation process calculates the base temperature from an engine speed and an engine load factor that are information indicative of a driving state of the internal combustion engine.

8. The controller according to claim 1, wherein the processing circuitry is installed in the temperature-estimated vehicle.

9. The controller according to claim 1, wherein the processing circuitry is installed in a vehicle included in the line of vehicles and differing from the temperature-estimated vehicle.

10. The controller according to claim 1, wherein the processing circuitry is an external server located outside the temperature-estimated vehicle.

11. A method for estimating a temperature of a component of an internal combustion engine installed in a vehicle, the method comprising:

executing a base temperature calculation process that calculates a base temperature of the component of the internal combustion engine from information on a driving state of the internal combustion engine;

executing a correction value calculation process that calculates a correction value for correcting the base temperature from information on a speed of the vehicle;

executing a vehicle line reflection process when the vehicle including the component of which temperature is estimated is a temperature-estimated vehicle that is in a line of vehicles in order to reflect, on the correction value, a tendency of the component to be less cooled when the temperature-estimated vehicle is a trailing vehicle than when the temperature-estimated vehicle is a leading vehicle;

executing a rearmost reflection process when the temperature-estimated vehicle is in the line of vehicles in order to reflect, on the correction value, a tendency of the component to be more cooled when the temperature-estimated vehicle is a rearmost vehicle than when the temperature-estimated vehicle is not the rearmost vehicle; and executing a component temperature estimation process that estimates the temperature of the component of the internal combustion engine by correcting the base temperature with the correction value.

* * * * *